US011624564B2

(12) United States Patent
Zhang et al.

(10) Patent No.: US 11,624,564 B2
(45) Date of Patent: Apr. 11, 2023

(54) HEAT EXCHANGER ASSEMBLY

(71) Applicant: Danfoss Micro Channel Heat Exchanger (Jiaxing) Co., Ltd., Zhejiang (CN)

(72) Inventors: Lingjie Zhang, Zhejiang (CN); Junfeng Jin, Zhejiang (CN); Xiangxun Lu, Zhejiang (CN); Pierre Olivier Pelletier, Zhejiang (CN)

(73) Assignee: Danfoss Micro Channel Heat Exchanger (Jiaxing) Co., Ltd., Zhejiang (CN)

( * ) Notice: Subject to any disclaimer, the term of this patent is extended or adjusted under 35 U.S.C. 154(b) by 65 days.

(21) Appl. No.: 16/477,365

(22) PCT Filed: Dec. 22, 2017

(86) PCT No.: PCT/CN2017/117977
§ 371 (c)(1),
(2) Date: Jul. 11, 2019

(87) PCT Pub. No.: WO2018/133623
PCT Pub. Date: Jul. 26, 2018

(65) Prior Publication Data

US 2020/0033072 A1 Jan. 30, 2020

(30) Foreign Application Priority Data

Jan. 20, 2017 (CN) ..... 201720076519.7

(51) Int. Cl.
*F28F 9/02* (2006.01)
*F28D 7/00* (2006.01)

(52) U.S. Cl.
CPC ..... *F28F 9/02* (2013.01); *F28D 7/0066* (2013.01)

(58) Field of Classification Search
CPC ..... F28D 7/0066; F28F 9/02
See application file for complete search history.

(56) References Cited

U.S. PATENT DOCUMENTS

2012/0227731 A1* 9/2012 Tamaura ..... F28F 13/08 126/664
2014/0124183 A1* 5/2014 Hwang ..... F25B 39/00 165/173

(Continued)

FOREIGN PATENT DOCUMENTS

CN 101788213 A * 7/2010
CN 101788213 A 7/2010

(Continued)

OTHER PUBLICATIONS

Wang, Heat Exchanger, 2009, Full Document (Year: 2009).*

(Continued)

*Primary Examiner* — Nael N Babaa
(74) *Attorney, Agent, or Firm* — McCormick, Paulding & Huber PLLC

(57) ABSTRACT

A heat exchanger assembly (100), the heat exchanger assembly (100) comprising: a first heat exchanger (1), the first heat exchanger (1) comprising a first communicating header pipe (10), a first header pipe (12), and heat exchange tubes (9) arranged between the first communicating header pipe (10) and the first header pipe (12); and a second heat exchanger (2), the second heat exchanger (2) comprising a second communicating header pipe (20), a second header pipe (22), and heat exchange tubes (9) arranged between the second communicating header pipe (20) and the second header pipe (22), wherein the first communicating header pipe (10) is provided with a partition plate (30) and thus has a plurality of first communicating chambers (14) arranged in the axial direction of the first communicating header pipe (10), the second communicating header pipe (20) is provided with a (Continued)

partition plate (30) and thus has a plurality of second communicating chambers (24) arranged in the axial direction of the second communicating header pipe (20), and the plurality of first communicating chambers (14) are in fluid communication with the corresponding plurality of second communicating chambers (24), such that a refrigerant entering the heat exchanger assembly (100) successively enters the second heat exchanger (2) and the first heat exchanger (1) in series. The heat exchange capability of the heat exchanger assembly (100) can be effectively improved.

13 Claims, 12 Drawing Sheets

(56) References Cited

U.S. PATENT DOCUMENTS

| | | | | |
|---|---|---|---|---|
| 2017/0030650 | A1* | 2/2017 | Yoo | F28D 1/0417 |
| 2019/0154342 | A1* | 5/2019 | Jin | F28D 1/0443 |

FOREIGN PATENT DOCUMENTS

| | | | |
|---|---|---|---|
| CN | 101806550 | A | 8/2010 |
| CN | 102252464 | A | 11/2011 |
| CN | 205784008 | U | 12/2016 |
| CN | 206420193 | U | 8/2017 |
| EP | 0 414 433 | A2 | 2/1991 |
| FR | 2 952 172 | A1 | 5/2011 |
| JP | H09-126591 | A | 5/1997 |
| WO | 2011/013672 | A1 | 2/2011 |
| WO | 2012/071196 | A2 | 5/2012 |
| WO | 2016/148508 | A1 | 9/2016 |

OTHER PUBLICATIONS

International Search Report For Serial No. PCT/CN2017/117977 dated Mar. 27, 2018.

Extended European Search Report for European Patent Application No. 17893006.1 dated Sep. 1, 2020.

* cited by examiner

HEAT EXCHANGER ASSEMBLY

CROSS-REFERENCE TO RELATED APPLICATIONS

This application is a National Stage application of International Patent Application No. PCT/CN2017/117977, filed on Dec. 22, 2017, which claims priority to Chinese Patent Application No. 201720076519.7 filed Jan. 20, 2017 each of which is hereby incorporated by reference in its entirety.

TECHNICAL FIELD

Embodiments of the present invention relate to a heat exchanger assembly.

BACKGROUND

A heat exchanger assembly may comprise a trapezoidal heat exchanger and a rectangular heat exchanger.

SUMMARY

The purpose of an embodiment of the present invention is to provide a heat exchanger assembly, thereby effectively improving the heat exchange capability of the heat exchanger assembly, for example.

The embodiment of the present invention provides a heat exchanger assembly, comprising: a first heat exchanger comprising a first communicating header pipe, a first header pipe, and heat exchange tubes arranged between the first communicating header pipe and the first header pipe; and a second heat exchanger comprising a second communicating header pipe, a second header pipe, and heat exchange tubes arranged between the second communicating header pipe and the second header pipe, wherein the first communicating header pipe is provided with a partition plate and thus has a plurality of first communicating chambers arranged in the axial direction of the first communicating header pipe, the second communicating header pipe is provided with a partition plate and thus has a plurality of second communicating chambers arranged in the axial direction of the second communicating header pipe, and the plurality of first communicating chambers are in fluid communication with the corresponding plurality of second communicating chambers, such that a refrigerant entering the heat exchanger assembly successively enters the second heat exchanger and the first heat exchanger in series.

According to an embodiment of the present invention, the first communicating header pipe is provided with one partition plate and thus has two first communicating chambers, the second communicating header pipe is provided with one partition plate and thus has two second communicating chambers, and the two first communicating chambers are respectively in fluid communication with the two second communicating chambers; and the first header pipe has one first chamber, the second header pipe is provided with one partition plate and thus has two second chambers arranged in the axial direction of the second header pipe, the two second chambers are respectively in fluid communication with the two second communicating chambers through the heat exchange tubes, and the two second chambers are respectively connected to a refrigerant inlet pipe and a refrigerant outlet pipe.

According to an embodiment of the present invention, the first heat exchanger is a trapezoidal heat exchanger, and the partition plate in the first communicating header pipe of the first heat exchanger is biased to the wider side of the first heat exchanger for a predetermined distance from the midpoint in the axial direction of the first communicating header pipe; and the second heat exchanger is a rectangular heat exchanger, the partition plate in the second communicating header pipe of the second heat exchanger is arranged at the midpoint in the axial direction of the second communicating header pipe, and the partition plate in the second header pipe is arranged at the midpoint in the axial direction of the second header pipe; or the first heat exchanger is a trapezoidal heat exchanger, the second heat exchanger is a rectangular heat exchanger, and the partition plate in the first communicating header pipe of the first heat exchanger is higher than the partition plate in the second communicating header pipe of the second heat exchanger.

According to an embodiment of the present invention, the first heat exchanger is a rectangular heat exchanger, and the partition plate in the first communicating header pipe of the first heat exchanger is arranged at the midpoint in the axial direction of the first communicating header pipe; the second heat exchanger is a trapezoidal heat exchanger, the partition plate in the second communicating header pipe of the second heat exchanger is biased to the wider side of the second heat exchanger for a predetermined distance from the midpoint in the axial direction of the second communicating header pipe, and the partition plate in the second header pipe is biased to the wider side of the second heat exchanger for a predetermined distance from the midpoint in the axial direction of the second header pipe; or the first heat exchanger is a rectangular heat exchanger, the second heat exchanger is a trapezoidal heat exchanger, and the partition plates in the second communicating header pipe of the second heat exchanger and the partition plate in the second header pipe are higher than the partition plate in the first communicating header pipe of the first heat exchanger. According to an embodiment of the present invention, the first communicating header pipe is provided with two partition plates and thus has three first communicating chambers, the second communicating header pipe is provided with one partition plate and thus has two second communicating chambers, and two first communicating chambers, at two ends of the first communicating header pipe, of the three first communicating chambers are respectively in fluid communication with the two second communicating chambers; the first header pipe is provided with one partition plate and thus has two first chambers arranged in the axial direction of the first header pipe, and the partition plate in the first header pipe is located between the two partition plates in the first communicating header pipe in the arrangement direction of the heat exchange tubes of the first heat exchanger; and the second header pipe is provided with one partition plate and thus has two second chambers arranged in the axial direction of the second header pipe, the two second chambers of the second header pipe are respectively in fluid communication with the two second communicating chambers of the second communicating header pipe through the heat exchange tubes, and the two second chambers are respectively connected to a refrigerant inlet pipe and a refrigerant outlet pipe.

According to an embodiment of the present invention, the partition plate in the first header pipe is located at the midpoint in the axial direction of the first header pipe, the partition plate in the second communicating header pipe is located at the midpoint in the axial direction of the second communicating header pipe, and the partition plate in the second header pipe is located at the midpoint in the axial direction of the second header pipe; or one of the two partition plates in the first communicating header pipe is higher than the partition plate in the second communicating header pipe, and the other of the two partition plates in the first communicating header pipe is lower than the partition plate in the second communicating header pipe.

According to an embodiment of the present invention, one of the first heat exchanger and the second heat exchanger is a trapezoidal heat exchanger, and the other of the first heat exchanger and the second heat exchanger is a rectangular heat exchanger.

According to an embodiment of the present invention, the first communicating header pipe is provided with two partition plates and thus has three first communicating chambers, the second communicating header pipe is provided with one partition plate and thus has two second communicating chambers, two adjacent first communicating chambers of the three first communicating chambers are in fluid communication with one of the two second communicating chambers, and the other of the three first communicating chambers is in fluid communication with the other of the two second communicating chambers; and the first header pipe has one first chamber, the second header pipe is provided with one partition plate and thus has two second chambers arranged in the axial direction of the second header pipe, the two second chambers of the second header pipe are respectively in fluid communication with the two second communicating chambers of the second communicating header pipe through the heat exchange tubes, and the two second chambers are respectively connected to a refrigerant inlet pipe and a refrigerant outlet pipe.

According to an embodiment of the present invention, the two partition plates in the first communicating header pipe are located on two sides of the midpoint in the axial direction of the first communicating header pipe, the partition plate in the second communicating header pipe is located at the midpoint in the axial direction of the second communicating header pipe, and the partition plate in the second header pipe is located at the midpoint in the axial direction of the second header pipe; or one of the two partition plates in the first communicating header pipe is higher than the partition plate in the second communicating header pipe, and the other of the two partition plates in the first communicating header pipe is lower than the partition plate in the second communicating header pipe. According to an embodiment of the present invention, the first heat exchanger is a trapezoidal heat exchanger, the second heat exchanger is a rectangular heat exchanger, the two adjacent first communicating chambers, on the wider side of the first heat exchanger, of the three first communicating chambers of the first heat exchanger are in fluid communication with one of the two second communicating chambers, and the other, on the narrower side of the first heat exchanger, of the three first communicating chambers is in fluid communication with the other of the two second communicating chambers.

According to an embodiment of the present invention, the first heat exchanger is a rectangular heat exchanger, the second heat exchanger is a trapezoidal heat exchanger, adjacent two of the three first communicating chambers of the first heat exchanger are in fluid communication with one, on the wider side of the second heat exchanger, of the two second communicating chambers, and the other of the three first communicating chambers is in fluid communication with the other, on the narrower side of the second heat exchanger, of the two second communicating chambers.

According to an embodiment of the present invention, the first communicating header pipe is provided with two partition plates and thus has three first communicating chambers, the second communicating header pipe is provided with two partition plates and thus has three second communicating chambers, and the three first communicating chambers are respectively in fluid communication with the three second communicating chambers; the first header pipe is provided with one partition plate and thus has two first chambers arranged in the axial direction of the first header pipe, and the second header pipe is provided with one partition plate and thus has two second chambers arranged in the axial direction of the second header pipe; two adjacent first communicating chambers of the three first communicating chambers of the first communicating header pipe are in fluid communication with one of the two first chambers of the first header pipe through the heat exchange tubes; two adjacent second communicating chambers of the three second communicating chambers of the second communicating header pipe are in fluid communication one of the two second chambers of the second header pipe through the heat exchange tubes; the other first communicating chamber of the three first communicating chambers of the first communicating header pipe is in fluid communication with the other of the two first chambers of the first header pipe through the heat exchange tubes and is in fluid communication with one second communicating chamber, at the end of the second communicating header pipe, of the two adjacent second communicating chambers of the three second communicating chambers of the second communicating header pipe; the other second communicating chamber of the three second communicating chambers of the second communicating header pipe is in fluid communication with the other of the two second chambers of the second header pipe through the heat exchange tubes and is in fluid communication with one first communicating chamber, at the end of the first communicating header pipe, of the two adjacent first communicating chambers of the three first communicating chambers of the first communicating header pipe; and the other of the two first chambers of the first header pipe and the other of the two second chambers of the second header pipe are respectively connected to a refrigerant inlet pipe and a refrigerant outlet pipe.

According to an embodiment of the present invention, the two partition plates in the first communicating header pipe are located on two sides of the midpoint in the axial direction of the first communicating header pipe, and the two partition plates in the second communicating header pipe are located on two sides of the midpoint in the axial direction of the second communicating header pipe. According to an embodiment of the present invention, the first heat exchanger is a trapezoidal heat exchanger, the second heat exchanger is a rectangular heat exchanger, and the two adjacent first communicating chambers of the three first communicating chambers of the first communicating header pipe are located on the wider side of the first heat exchanger.

According to an embodiment of the present invention, the first heat exchanger is a rectangular heat exchanger, the second heat exchanger is a trapezoidal heat exchanger, and the two adjacent second communicating chambers of the three second communicating chambers of the second communicating header pipe are located on the narrower side of the second heat exchanger.

According to an embodiment of the present invention, the heat exchange capability of the heat exchanger assembly is effectively improved.

DETAILED DESCRIPTION

Figure 1:
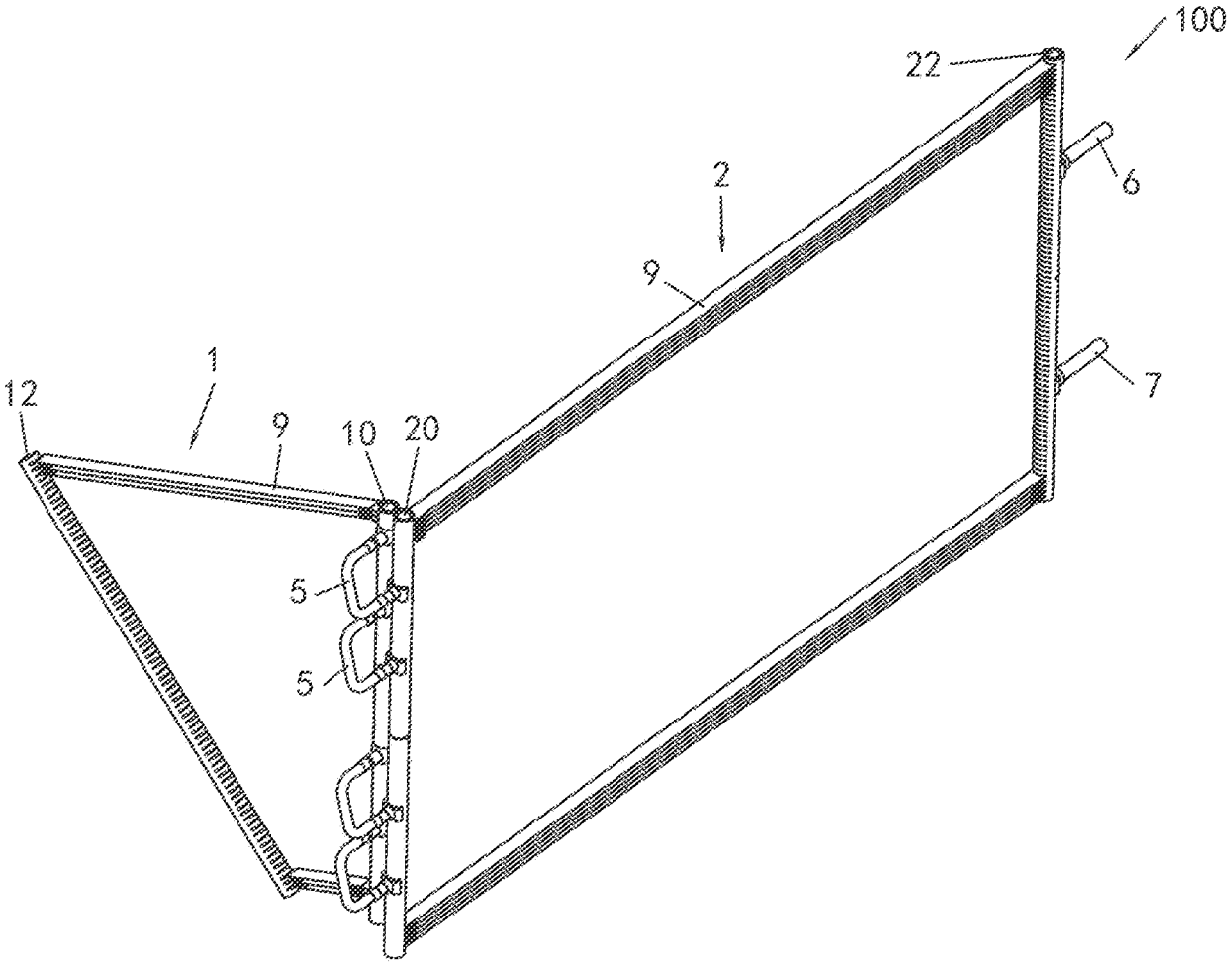
FIG. 1 is a perspective schematic diagram of a heat exchanger assembly according to an embodiment of the present invention.

The present invention will be described below in detail with reference to the drawings in conjunction with the embodiments of the present invention. FIGS. 1 to 12 show a heat exchanger assembly 100 and an exemplary use state of the heat exchanger assembly 100 according to embodiments of the present invention. In order to make the drawings clearer, fins and heat exchange tubes in the middle part of the heat exchanger in FIGS. 1, 6, 11 and 12 are not shown. As shown in FIGS. 1 to 12, a heat exchanger assembly 100 according to one embodiment of the present invention comprises: a first heat exchanger 1, the first heat exchanger 1 comprising a first communicating header pipe 10, a first header pipe 12 and heat exchange tubes 9 arranged between the first communicating header pipe 10 and the first header pipe 12; and a second heat exchanger 2, the second heat exchanger 2 comprising a second communicating header pipe 20, a second header pipe 22, and heat exchange tubes 9 arranged between the second communicating header pipe 20 and the second header pipe 22. The first communicating header pipe 10 is provided with a partition plate 30 and thus has a plurality of first communicating chambers 14 arranged in the axial direction of the first communicating header pipe 10, the second communicating header pipe 20 is provided with a partition plate 30 and thus has a plurality of second communicating chambers 24 arranged in the axial direction of the second communicating header pipe 20, and the plurality of first communicating chambers 14 are in fluid communication with the corresponding plurality of second communicating chambers 24, such that a refrigerant entering the heat exchanger assembly 100 successively enters the second heat exchanger 2 and the first heat exchanger 1 in series. The heat exchange tubes 9 may be flat tubes, and the first heat exchanger 1 and the second heat exchanger 2 are provided with fins located between the flat tubes.

Referring to FIGS. 1 to 5, the first communicating header pipe 10 of the first heat exchanger 1 is connected to the second communicating header pipe 20 of the second heat exchanger 2 through a pipeline 5. Specifically, the plurality of first communicating chambers 14 are in fluid communication with the corresponding plurality of second communicating chambers 24 through the pipeline 5. Two heat exchanger assemblies 100 form a heat exchanger of an air-cooled modular chiller. The pipeline 5 may be a U-shaped pipe (e.g., a copper pipe) or a flute-shaped pipe (e.g., a copper pipe) or the like. The first communicating header pipe 10 of the first heat exchanger 1 and the second communicating header pipe 20 of the second heat exchanger 2 are fit in parallel. The plane of the heat exchanger core body of the first heat exchanger 1 forms an angle of 90 degree with the plane of the heat exchanger core body of the second heat exchanger 2. The refrigerant inlet pipe 6 (an inlet connecting pipe) of the heat exchanger assembly 100 is located on the second header pipe 22 of the second heat exchanger 2 (a rectangular heat exchanger), and the refrigerant outlet pipe 7 (an outlet connecting pipe) may be arranged on the second header pipe 22 of the second heat exchanger 2 or the first header pipe 12 of the first heat exchanger 1 (a trapezoidal heat exchanger) according to the need. The first heat exchanger 1 (a trapezoidal heat exchanger) is approximately vertically arranged. The first communicating header pipe 10 of the first heat exchanger 1 and the second communicating header pipe 20 of the second heat exchanger 2 are fit in parallel. Therefore, the second heat exchanger 2 (a rectangular heat exchanger) is obliquely arranged.

Referring to FIGS. 6 to 10, the first communicating header pipe 10 of the first heat exchanger 1 is connected to the second communicating header pipe 20 of the second heat exchanger 2 through a pipeline 5. Specifically, the plurality of first communicating chambers 14 are in fluid communication with the corresponding plurality of second communicating chambers 24 through the pipeline 5. Two heat exchanger assemblies 100 form a heat exchanger of an air-cooled modular chiller. The pipeline 5 may be a U-shaped pipe (e.g., a copper pipe) or a flute-shaped pipe (e.g., a copper pipe) or the like. The first communicating header pipe 10 of the first heat exchanger 1 and the second communicating header pipe 20 of the second heat exchanger 2 are fit in parallel. The plane of the heat exchanger core body of the first heat exchanger 1 forms an angle of 90 degree with the plane of the heat exchanger core body of the second heat exchanger 2. The refrigerant inlet pipe 6 (an inlet connecting pipe) of the heat exchanger assembly 100 is located on the second header pipe 22 of the second heat exchanger 2 (a trapezoidal heat exchanger), and the refrigerant outlet pipe 7 (an outlet connecting pipe) may be arranged on the second header pipe 22 of the second heat exchanger 2 or the first header pipe 12 of the first heat exchanger 1 (a rectangular heat exchanger) according to the need. The first heat exchanger 1 (a rectangular heat exchanger) is approximately vertically arranged. The first communicating header pipe 10 of the first heat exchanger 1 and the second communicating header pipe 20 of the second heat exchanger 2 are fit in parallel. Therefore, the second heat exchanger 2 (a trapezoidal heat exchanger) is obliquely arranged.

Figure 2:
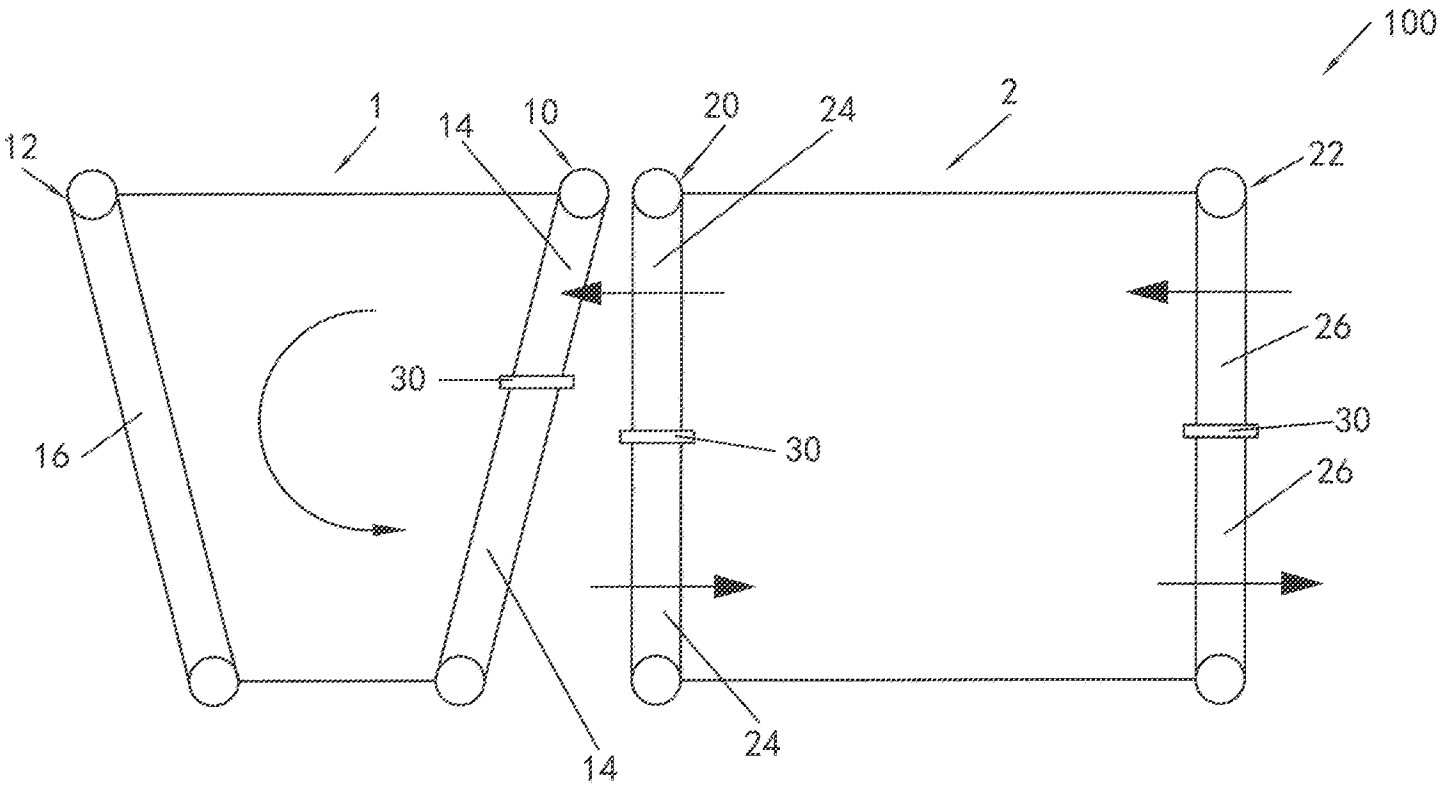
FIGS. 2 to 5 are schematic diagrams of a heat exchanger assembly according to an embodiment of the present invention.
Figure 7:
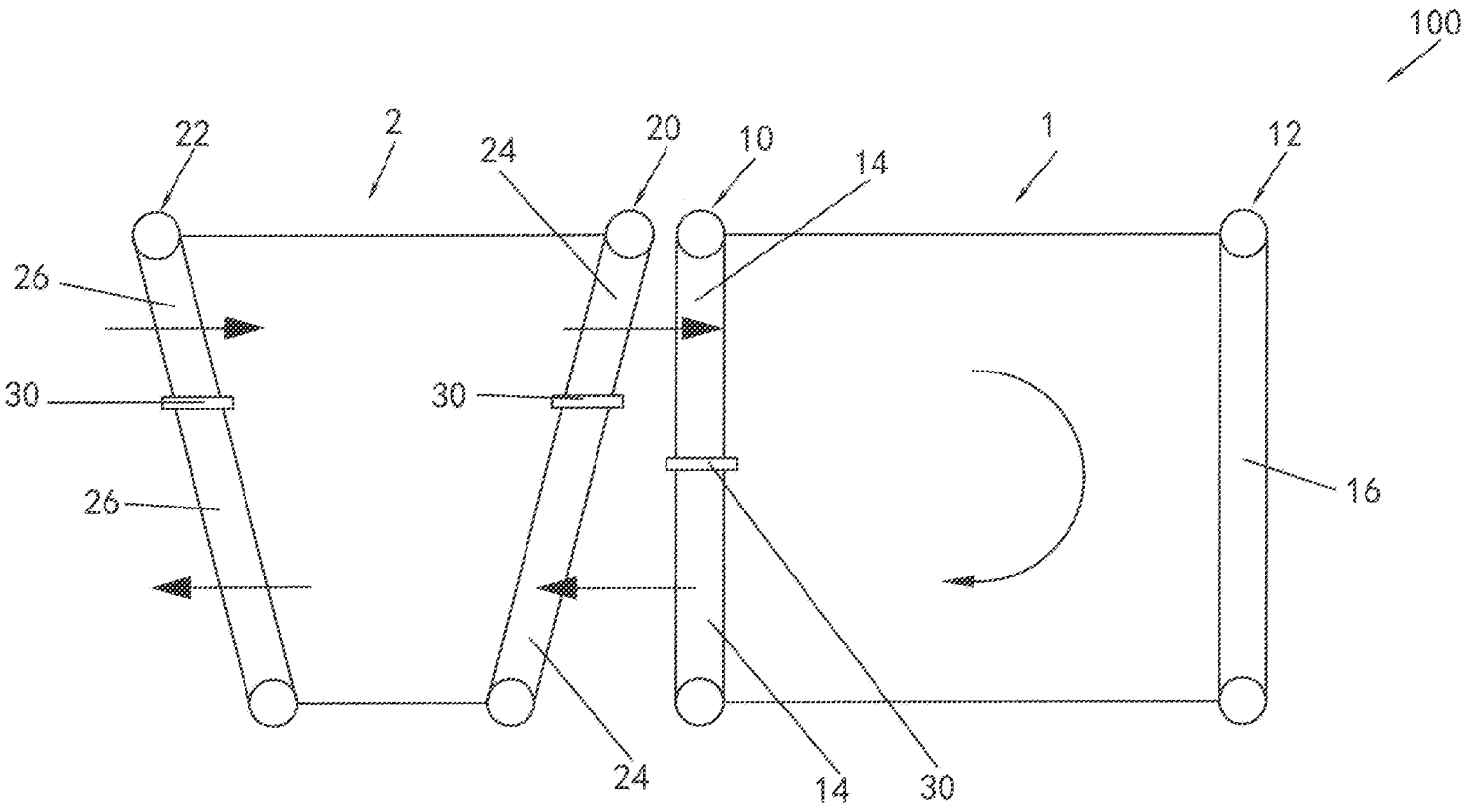
FIGS. 7 to 10 are schematic diagrams of a heat exchanger assembly according to an embodiment of the present invention.

In the embodiment of the present invention, referring to FIGS. 2 and 7, the first communicating header pipe 10 is provided with one partition plate 30 and thus has two first communicating chambers 14, the second communicating header pipe 20 is provided with one partition plate 30 and thus has two second communicating chambers 24, the two first communicating chambers 14 are respectively in fluid communication with the two second communicating chambers 24, the first header pipe 12 has one first chamber 16, the second header pipe 22 is provided with one partition plate 30 and thus has two second chambers 26 arranged in the axial direction of the second header pipe 22, the two second chambers 26 are respectively in fluid communication with the two second communicating chambers 24 through the heat exchange tubes 9, and the two second chambers 26 are respectively connected to a refrigerant inlet pipe 6 and a refrigerant outlet pipe 7.

In the embodiment of the present invention, referring to FIG. 2, the first heat exchanger 1 is a trapezoidal heat exchanger, the partition plate 30 in the first communicating header pipe 10 of the first heat exchanger 1 is biased to the wider side of the first heat exchanger 1 for a predetermined distance from the midpoint in the axial direction of the first communicating header pipe 10, the second heat exchanger 2 is a rectangular heat exchanger, the partition plate 30 in the second communicating header pipe 20 of the second heat exchanger 2 is arranged at the midpoint in the axial direction of the second communicating header pipe 20, and the partition plate 30 in the second header pipe 22 is arranged at the midpoint in the axial direction of the second header pipe 22.

In the embodiment as shown in FIG. 2, the first heat exchanger 1 is a trapezoidal heat exchanger, the second heat exchanger 2 is a rectangular heat exchanger, and the partition plate 30 in the first communicating header pipe 10 of the first heat exchanger 1 is higher than the partition plate 30 in the second communicating header pipe 20 of the second heat exchanger 2. In this way, the area of the upper part is equal to the lower part of the first heat exchanger 1, and the refrigerant distribution is more uniform.

In the embodiment of the present invention, referring to FIG. 7, the first heat exchanger 1 is a rectangular heat exchanger, and the partition plate 30 in the first communicating header pipe 10 of the first heat exchanger 1 is arranged at the midpoint in the axial direction of the first communicating header pipe 10; and the second heat exchanger 2 is a trapezoidal heat exchanger, the partition plate 30 in the second communicating header pipe 20 of the second heat exchanger 2 is biased to the wider side of the second heat exchanger 2 for a predetermined distance from the midpoint in the axial direction of the second communicating header pipe 20, and the partition plate 30 in the second header pipe 22 is biased to the wider side of the second heat exchanger 2 for a predetermined distance from the midpoint in the axial direction of the second header pipe 22.

Figure 3:
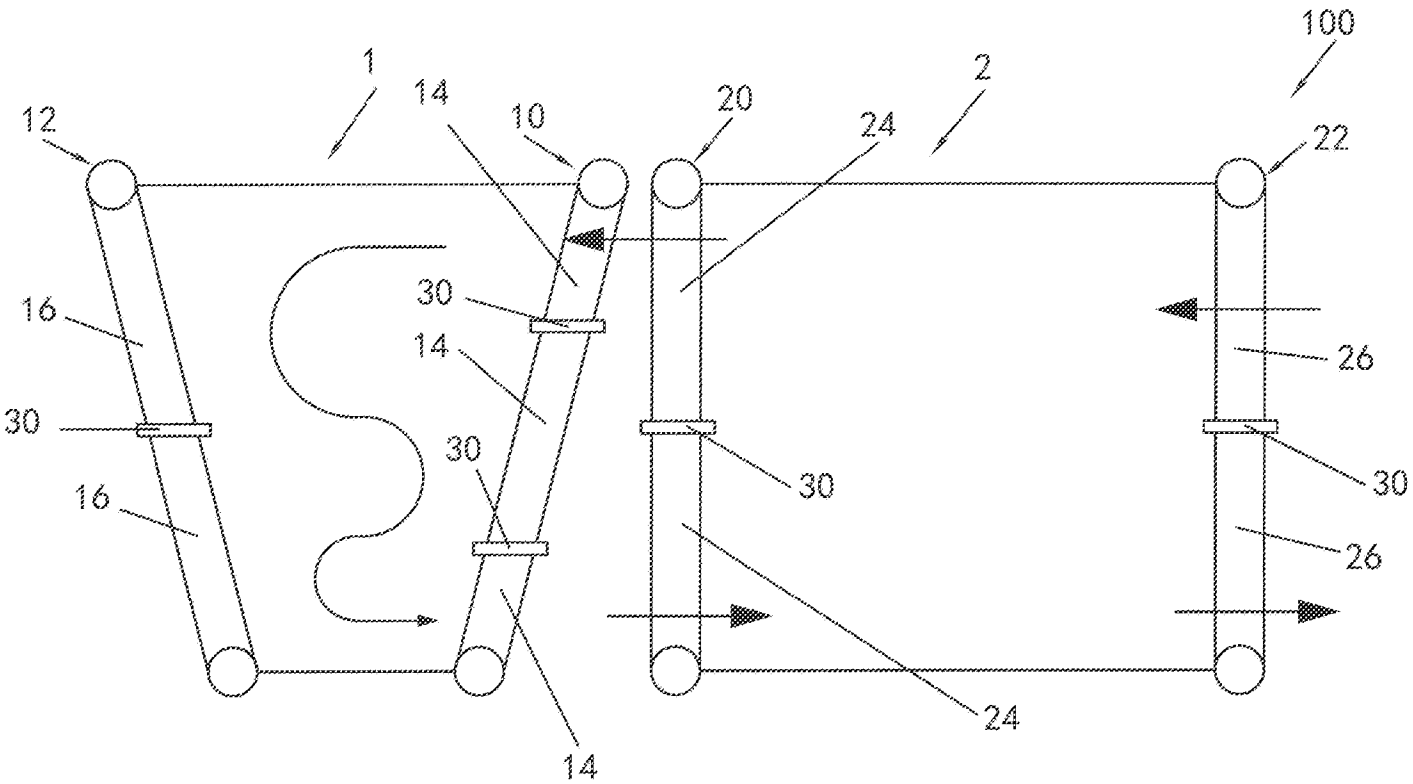
Figure 8:
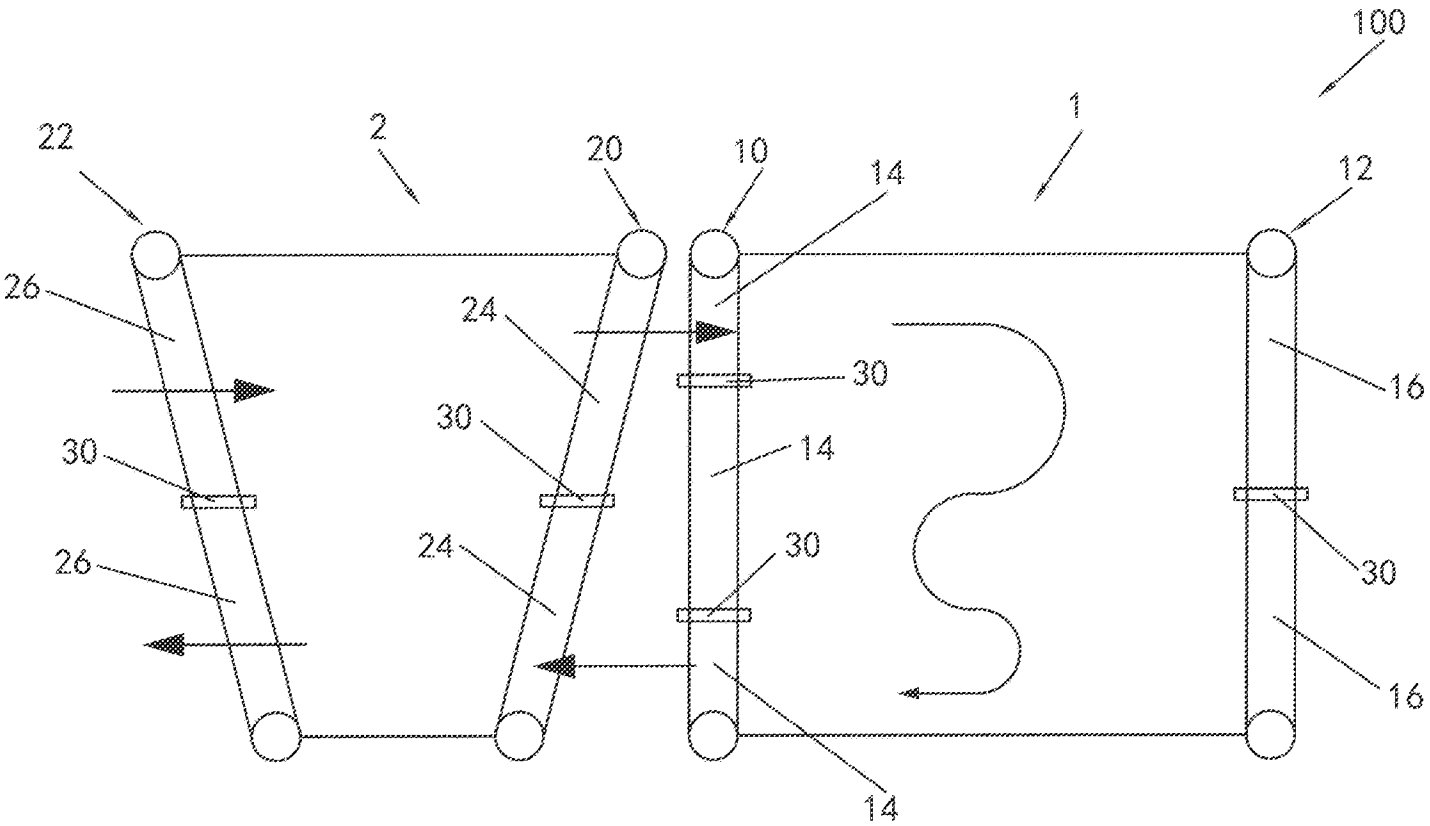

In the embodiment of the present invention, referring to FIGS. 3 and 8, the first communicating header pipe 10 is provided with two partition plates 30 and thus has three first communicating chambers 14, the second communicating header pipe 20 is provided with one partition plate 30 and thus has two second communicating chambers 24, and two first communicating chambers 14, at two ends of the first communicating header pipe 10, of the three first communicating chambers 14 are respectively in fluid communication with the two second communicating chambers 24; the first header pipe 12 is provided with one partition plate 30 and thus has two first chambers 16 arranged in the axial direction of the first header pipe 12, and the partition plate 30 in the first header pipe 12 is located between the two partition plates 30 in the first communicating header pipe 10 in the arrangement direction of the heat exchange tubes 9 of the first heat exchanger 1; and the second header pipe 22 is provided with one partition plate 30 and thus has two second chambers 26 arranged in the axial direction of the second header pipe 22, the two second chambers 26 of the second header pipe 22 are respectively in fluid communication with the two second communicating chambers 24 of the second communicating header pipe 20 through the heat exchange tubes 9, and the two second chambers 26 are respectively connected to a refrigerant inlet pipe 6 and a refrigerant outlet pipe 7. In the embodiment of the present invention, referring to FIGS. 3 and 8, the partition plate 30 in the first header pipe 12 is located at the midpoint in the axial direction of the first header pipe 12, the partition plate 30 in the second communicating header pipe 20 is located at the midpoint in the axial direction of the second communicating header pipe 20, and the partition plate 30 in the second header pipe 22 is located at the midpoint in the axial direction of the second header pipe 22.

In the embodiment of the present invention, referring to FIGS. 3 and 8, one of the first heat exchanger 1 and the second heat exchanger 2 is a trapezoidal heat exchanger, and the other of the first heat exchanger 1 and the second heat exchanger 2 is a rectangular heat exchanger.

In the embodiment as shown in FIG. 3, the first heat exchanger 1 is a trapezoidal heat exchanger, the first communicating header pipe 10 is provided with two partition plates 30, the inner chamber of the first communicating header pipe 10 is divided into three first communicating chambers 14, and the first heat exchanger 1 forms four loops. With the heat exchanger assembly 100 illustrated in the embodiment, the refrigerant-side pressure drop can be increased, and the unit operates more stably. In the illustrated embodiment, the first communicating header pipe 10 is provided with two partition plates 30, and the inner chamber of the first communicating header pipe 10 is divided into three first communicating chambers 14. The two partition plates 30 in the first communicating header pipe 10 are respectively higher than and lower than the partition plate 30 in the second communicating header pipe 20.

Figure 4:
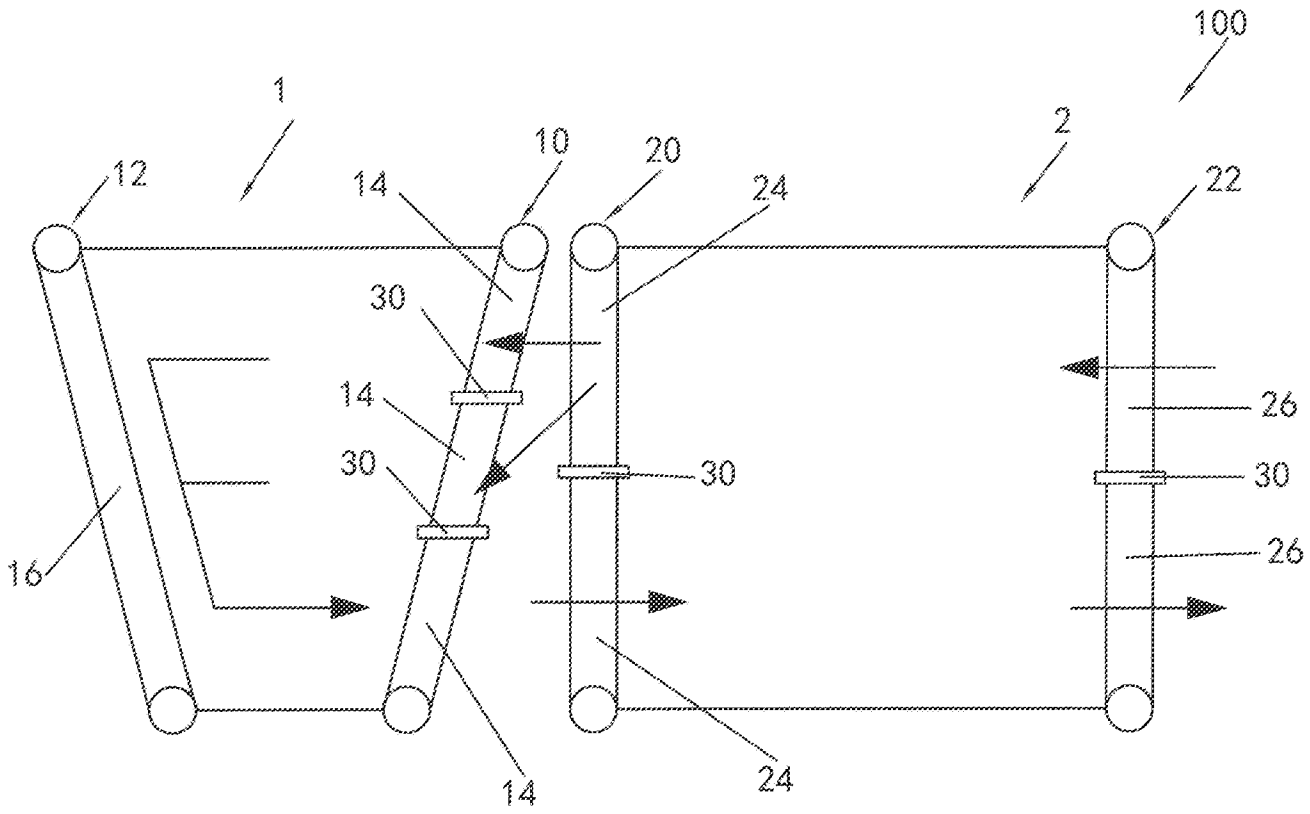
Figure 9:
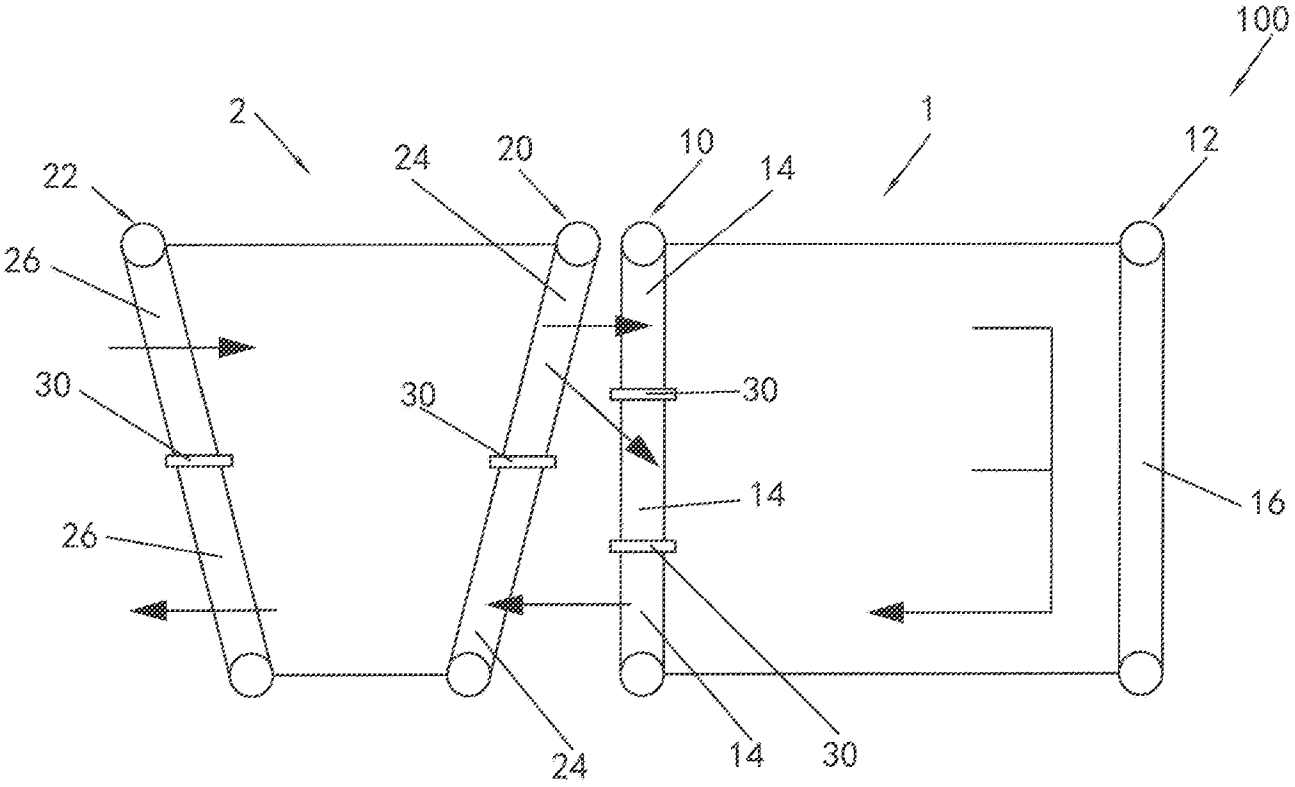

In the embodiment of the present invention, referring to FIGS. 4 and 9, the first communicating header pipe 10 is provided with two partition plates 30 and thus has three first communicating chambers 14, the second communicating header pipe 20 is provided with one partition plate 30 and thus has two second communicating chambers 24, two adjacent first communicating chambers 14 of the three first communicating chambers 14 are in fluid communication with one of the two second communicating chambers 24, and the other of the three first communicating chambers 14 is in fluid communication with the other of the two second communicating chambers 24; and the first header pipe 12 has one first chamber 16, the second header pipe 22 is provided with one partition plate 30 and thus has two second chambers 26 arranged in the axial direction of the second header pipe 22, the two second chambers 26 of the second header pipe 22 are respectively in fluid communication with the two second communicating chambers 24 of the second communicating header pipe 20 through the heat exchange tubes 9, and the two second chambers 26 are respectively connected to a refrigerant inlet pipe 6 and a refrigerant outlet pipe 7. In the embodiment of the present invention, the two partition plates 30 in the first communicating header pipe 10 are located on two sides of the midpoint in the axial direction of the first communicating header pipe 10, the partition plate 30 in the second communicating header pipe 20 is located at the midpoint in the axial direction of the second communicating header pipe 20, and the partition plate 30 in the second header pipe 22 is located at the midpoint in the axial direction of the second header pipe 22.

In the embodiment of the present invention, referring to FIG. 4, the first heat exchanger 1 is a trapezoidal heat exchanger, the second heat exchanger 2 is a rectangular heat exchanger, the two adjacent first communicating chambers 14, on the wider side of the first heat exchanger 1, of the three first communicating chambers 14 of the first heat exchanger 1 are in fluid communication with one of the two second communicating chambers 24, and the other, on the narrower side of the first heat exchanger 1, of the three first communicating chambers 14 is in fluid communication with the other of the two second communicating chambers 24. In the illustrated embodiment, the first communicating header pipe 10 is provided with two partition plates 30, and the inner chamber of the first communicating header pipe 10 is divided into three first communicating chambers 14. The two partition plates 30 in the first communicating header pipe 10 are respectively higher than and lower than the partition plate 30 in the second communicating header pipe 20. The refrigerant in the second heat exchanger 2 enters the two adjacent first communicating chambers 14, on the wider side of the first heat exchanger 1, of the three communicating chambers 14 of the first heat exchanger 1 through a three-way tube (one divided into two). Using the feature of higher wind speed at the upper part of the first heat exchanger 1, the refrigerant performs heat exchange in parallel, such that the heat transfer coefficient can be improved and the heat exchange capacity can be increased.

In the embodiment of the present invention, referring to FIG. 9, the first heat exchanger 1 is a rectangular heat exchanger, the second heat exchanger 2 is a trapezoidal heat exchanger, adjacent two of the three first communicating chambers 14 of the first heat exchanger 1 are in fluid communication with one, on the wider side of the second heat exchanger 2, of the two second communicating chambers 24, and the other of the three first communicating chambers 14 is in fluid communication with the other, on the narrower side of the second heat exchanger 2, of the two second communicating chambers 24.

Figure 5:
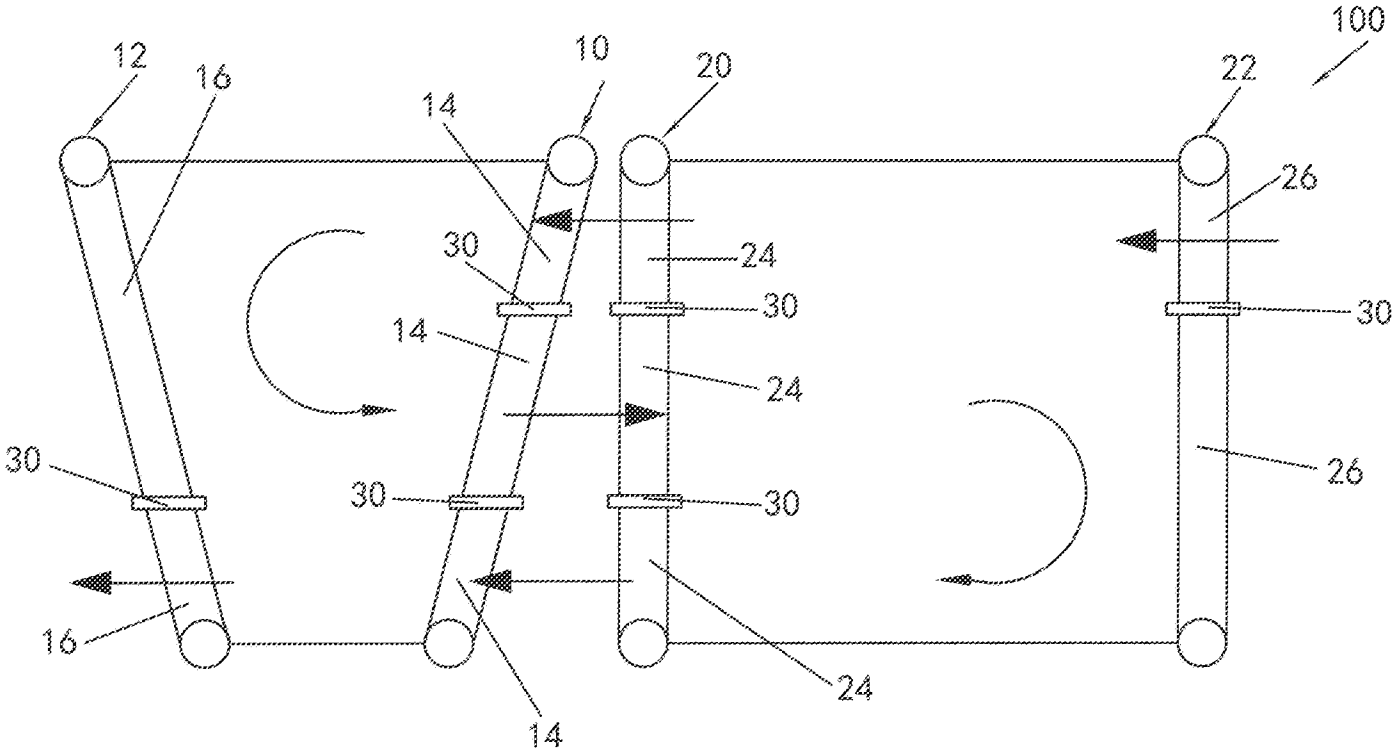
Figure 6:
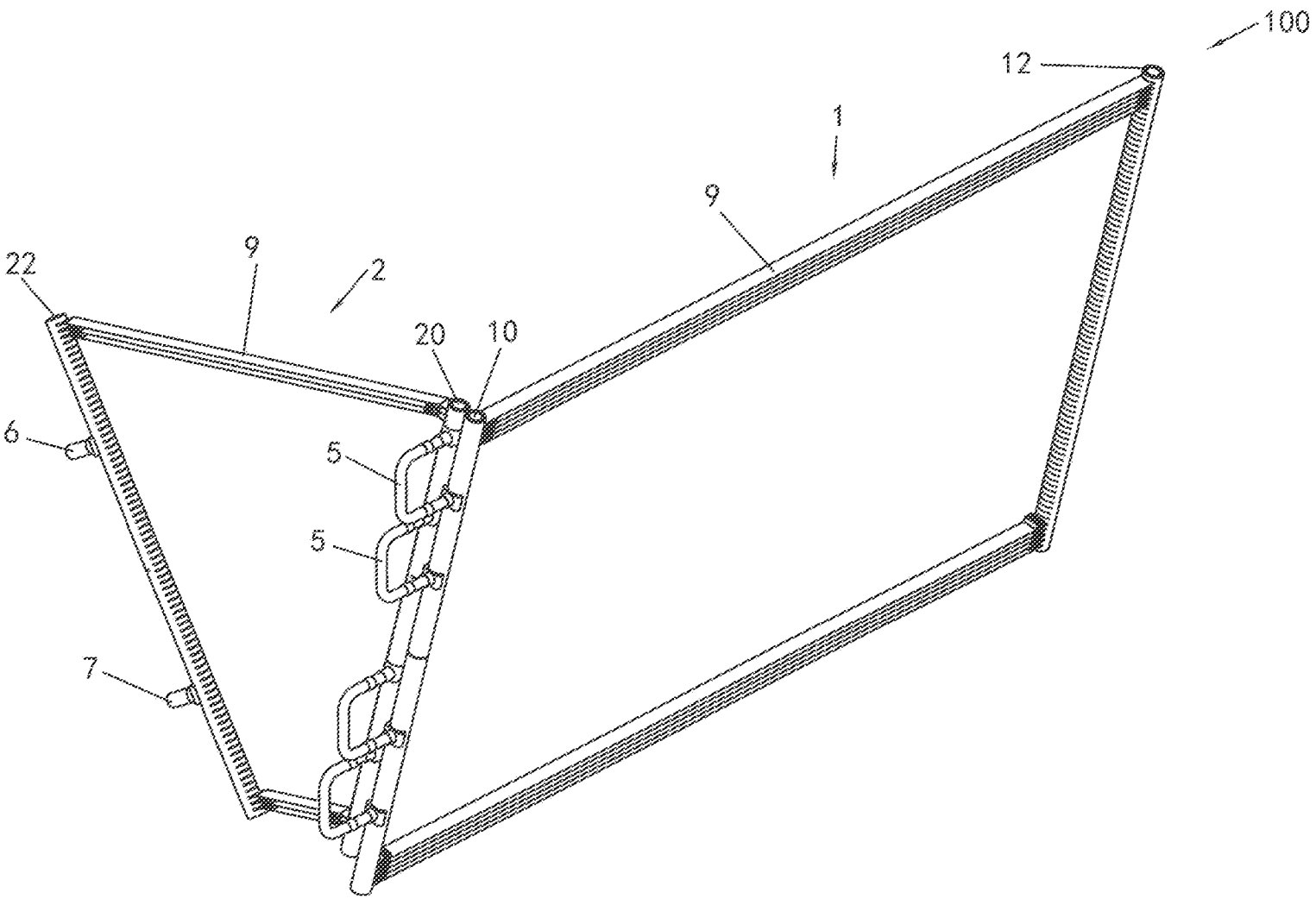
FIG. 6 is a perspective schematic diagram of a heat exchanger assembly according to an embodiment of the present invention.
Figure 10:
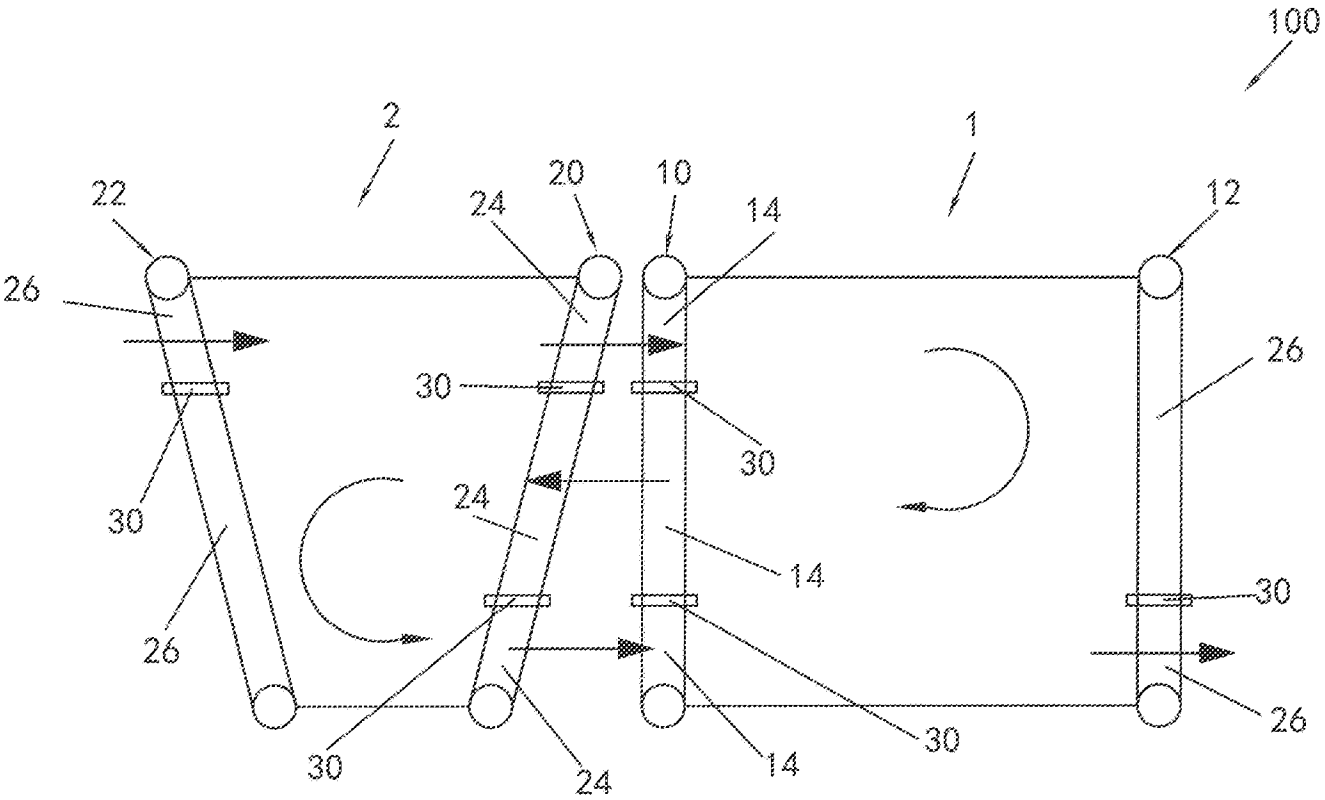

In the embodiment of the present invention, referring to FIGS. 5 and 10, the first communicating header pipe 10 is provided with two partition plates 30 and thus has three first communicating chambers 14, the second communicating header pipe 20 is provided with two partition plates 30 and thus has three second communicating chambers 24, and the three first communicating chambers 14 are respectively in fluid communication with the three second communicating chambers 24; the first header pipe 12 is provided with one partition plate 30 and thus has two first chambers 16 arranged in the axial direction of the first header pipe 12, and the second header pipe 22 is provided with one partition plate 30 and thus has two second chambers 26 arranged in the axial direction of the second header pipe 22; two adjacent first communicating chambers 14 of the three first communicating chambers 14 of the first communicating header pipe 10 are in fluid communication with one of the two first chambers 16 of the first header pipe 12 through the heat exchange tubes 9; two adjacent second communicating chambers 24 of the three second communicating chambers 24 of the second communicating header pipe 20 are in fluid communication one of the two second chambers 26 of the second header pipe 22 through the heat exchange tubes 9; the other first communicating chamber 14 of the three first communicating chambers 14 of the first communicating header pipe 10 is in fluid communication with the other of the two first chambers 16 of the first header pipe 12 through the heat exchange tubes 9 and is in fluid communication with one second communicating chamber 24, at the end of the second communicating header pipe 20, of the two adjacent second communicating chambers 24 of the three second communicating chambers 24 of the second communicating header pipe 20; the other second communicating chamber 24 of the three second communicating chambers 24 of the second communicating header pipe 20 is in fluid communication with the other of the two second chambers 26 of the second header pipe 22 through the heat exchange tubes 9 and is in fluid communication with one first communicating chamber 14, at the end of the first communicating header pipe 10, of the two adjacent first communicating chambers 14 of the three first communicating chambers 14 of the first communicating header pipe 10; and the other of the two first chambers 16 of the first header pipe 12 and the other of the two second chambers 26 of the second header pipe 22 are respectively connected to a refrigerant inlet pipe 6 and a refrigerant outlet pipe 7. According to the example of the present invention, the two partition plates 30 in the first communicating header pipe 10 are located on two sides of the midpoint in the axial direction of the first communicating header pipe 10, and the two partition plates 30 in the second communicating header pipe 20 are located on two sides of the midpoint in the axial direction of the second communicating header pipe 20. In the embodiment of the present invention, referring to FIG. 5, the first heat exchanger 1 is a trapezoidal heat exchanger, the second heat exchanger 2 is a rectangular heat exchanger, and the two adjacent first communicating chambers 14 of the three first communicating chambers 14 of the first communicating header pipe 10 are located on the wider side of the first heat exchanger 1. In the illustrated embodiment, the inner chamber of the first communicating header pipe 10 is divided into three first communicating chambers 14, and the inner chamber of the second communicating header pipe 20 is divided into three second communicating chambers 24. The two partition plates 30 in the first communicating header pipe 10 are in alignment with the partition plate 30 in the second communicating header pipe 20. An S-shaped refrigerant serial loop is formed in the heat exchanger assembly 100, and three loops are formed. The refrigerant enters from the upper second chamber 26 of the two second chambers 26 of the second header pipe 22 and flow out from the lower first chamber 16 of the two first chambers 16 of the first header pipe 12.

In the embodiment of the present invention, referring to FIG. 10, the first heat exchanger 1 is a rectangular heat exchanger, the second heat exchanger 2 is a trapezoidal heat exchanger, and the two adjacent second communicating chambers 24 of the three second communicating chambers 24 of the second communicating header pipe 20 are located on the narrower side of the second heat exchanger 2.

As shown in FIGS. 1 to 12, in the heat exchanger assembly 100 according to an embodiment of the present invention, the refrigerant successively enters the trapezoidal heat exchanger and the rectangular heat exchanger in series, or successively enter the rectangular heat exchanger and the trapezoidal heat exchanger. The trapezoidal heat exchanger and the rectangular heat exchanger are connected in series through copper tubes to form the heat exchanger assembly. A plurality of partition plates are arranged in the header pipe to realize different flow loops. Two heat exchanger assemblies are assembled to form a combined micro-channel heat exchanger, which can effectively increase the heat exchange area of the chiller and improve the heat exchange capacity. The refrigerant can enter and exit from the same side or along a diagonal direction, which facilitates the installation and connection of the heat exchanger and the unit.

Figure 11:
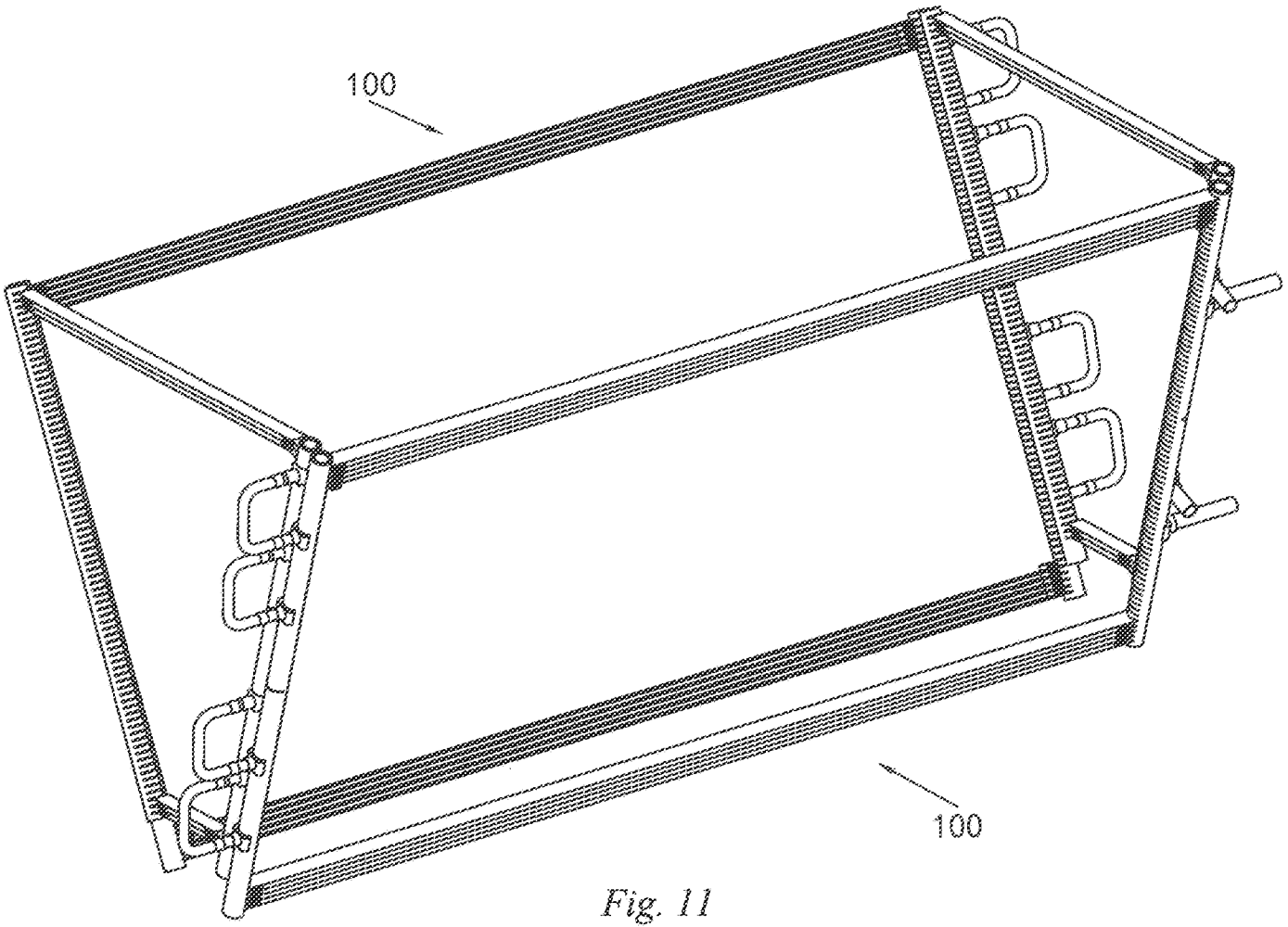
FIGS. 11 and 12 show a combined heat exchanger constituted by a heat exchanger assembly according to an embodiment of the present invention.
Figure 12:
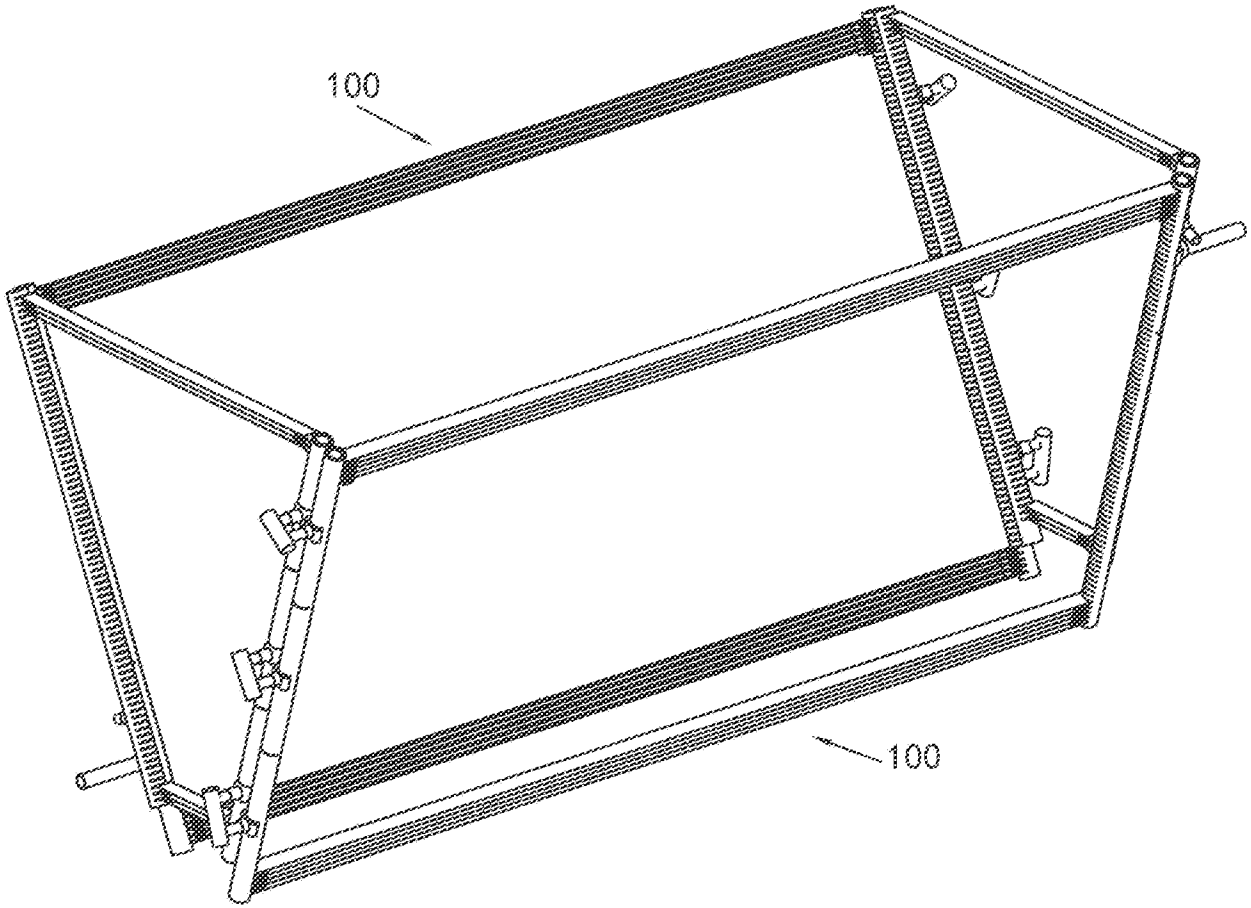

As shown in FIGS. 11 and 12, two different heat exchanger modules may be assembled into a combined micro-channel heat exchanger for an air-cooled modular chiller.

The micro-channel heat exchanger in FIG. 11 is formed by the heat exchanger assembly as shown in FIG. 2 and the heat exchanger assembly as shown in FIG. 7. The inlet connecting pipe and the outlet connecting pipe of the two heat exchanger assemblies are respectively located on the header pipes of trapezoidal heat exchanger and rectangular heat exchanger, and both of them are on the same side. The heat exchanger assembly as shown in FIG. 3 and the heat exchanger assembly as shown in FIG. 8 may be combined, the heat exchanger assembly as shown in FIG. 4 and the heat exchanger assembly as shown in FIG. 9 may be combined, the heat exchanger assembly as shown in FIG. 5 and the heat exchanger assembly as shown in FIG. 10 may be combined, and the inlet connecting pipe and the outlet connecting pipe are on the same side.

Installation personnel can easily operate on the same side when welding copper pipes for connecting heat exchangers with compressors and expansion valves. Refrigerant gas from the compressor enters the micro-channel heat exchanger through the three-way joint, the length of the inlet copper connecting pipe is the same, and no heat exchanger assembly has a complex long connecting pipe, such that the pressure drop of the two heat exchanger assemblies is more uniform, and the refrigerant distribution is more uniform. The micro-channel heat exchanger in FIG. 12 is formed by the heat exchanger assembly as shown in FIG. 5 and the heat exchanger assembly as shown in FIG. 10. The inlet connecting pipes of both heat exchanger assemblies are on the same side, and the outlet connecting pipes are on the other side in the diagonal direction. The refrigerant gas from the compressor enters from the upper parts of the header pipes of the rectangular heat exchanger and the trapezoidal heat exchanger through three-way joints. After a three-loop heat exchange process in the respective heat exchanger assemblies, the refrigerant gas respectively flows out from the lower parts of the header pipes of the rectangular heat exchanger and the trapezoidal heat exchanger in the diagonal direction. Similarly, the length of the copper connecting pipe from the three-way joint to the inlet is the same, which can realize the uniform distribution of refrigerant.

As shown in FIGS. 1 to 12, the heat exchanger assembly 100 according to an embodiment of the present invention has the advantages of increased heat exchange area, uniform distribution of refrigerant and improved heat exchange capacity. Compared with the heat exchanger of a traditional air-cooled modular chiller, the V-shaped areas on both sides are fully utilized, and the area is increased by about 22%, and the length of the copper connecting pipe from the three-way joint to the inlet of the heat exchanger assembly is the same, such that the refrigerant in the two heat exchanger assemblies can be uniformly distributed, and the heat exchange capacity can be effectively improved. In addition, there are various flow paths and connecting pipes. Two, three or four loops can be realized, and the flow paths may be in a relationship of series connection or series-parallel connection. The inlet connecting pipe and the outlet connecting pipe may be on the same side or on the diagonal sides. Various flow path and connecting pipe forms can meet the needs of different customer unit settings and different working conditions. Moreover, the heat exchanger assembly 100 according to embodiments of the present invention is convenient to transport and is simple and convenient to install. The heat exchanger cores disassembled to be in a flat plate state are boxed and transported, thus not occupying large spaces; and customers may use U-shaped copper pipes, flute-shaped pipes or three-way pipes to combine the four flat plate cores into an integral heat exchanger.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A heat exchanger assembly, comprising:

a first heat exchanger comprising a first communicating header pipe, a first header pipe, and heat exchange tubes arranged between the first communicating header pipe and the first header pipe; and a second heat exchanger comprising a second communicating header pipe, a second header pipe, and heat exchange tubes arranged between the second communicating header pipe and the second header pipe, wherein the first communicating header pipe is provided with a first partition plate and thus has two first communicating chambers arranged in the axial direction of the first communicating header pipe, the second communicating header pipe is provided with a second partition plate and thus has two second communicating chambers arranged in the axial direction of the second communicating header pipe, and the two first communicating chambers are in fluid communication with the corresponding two second communicating chambers, such that a refrigerant entering the heat exchanger assembly successively enters the second heat exchanger and the first heat exchanger in series;

wherein one of the first heat exchanger and the second heat exchanger is a trapezoidal heat exchanger, and the other of the first heat exchanger and the second heat exchanger is a rectangular heat exchanger;

wherein the first header pipe has a first chamber, the second header pipe is provided with a third partition plate and thus has two second chambers arranged in the axial direction of the second header pipe, the two second chambers are respectively in fluid communication with the two second communicating chambers through the heat exchange tubes, and the two second chambers are respectively connected to a refrigerant inlet pipe and a refrigerant outlet pipe; and wherein the first heat exchanger is a trapezoidal heat exchanger, and the first partition plate in the first communicating header pipe of the first heat exchanger is biased to the wider side of the first heat exchanger for a predetermined distance from the midpoint in the axial direction of the first communicating header pipe; and the second heat exchanger is a rectangular heat exchanger, the second partition plate in the second communicating header pipe of the second heat exchanger is arranged at the midpoint in the axial direction of the second communicating header pipe, and the third partition plate in the second header pipe is arranged at the midpoint in the axial direction of the second header pipe; or the first heat exchanger is a trapezoidal heat exchanger, the second heat exchanger is a rectangular heat exchanger, and the first partition plate in the first communicating header pipe of the first heat exchanger is higher than the second partition plate in the second communicating header pipe of the second heat exchanger.

2. The heat exchanger assembly according to claim 1, wherein the first communicating header pipe is provided with two partition plates, the first partition plate and a fourth partition plate, and thus has three first communicating chambers, two of which are the two first communicating chambers; the second communicating header pipe is provided with one partition plate, the second partition plate, and thus has two second communicating chambers, and two first communicating chambers, at two ends of the first communicating header pipe, of the three first communicating chambers are respectively in fluid communication with the two second communicating chambers; the first header pipe is provided with one partition plate, a fifth partition plate, and thus has two first chambers arranged in the axial direction of the first header pipe, and the fifth partition plate in the first header pipe is located between the two partition plates in the first communicating header pipe in the arrangement direction of the heat exchange tubes of the first heat exchanger; and the second header pipe is provided with one partition plate, the third partition plate, and thus has two second chambers arranged in the axial direction of the second header pipe, the two second chambers of the second header pipe are respectively in fluid communication with the two second communicating chambers of the second communicating header pipe through the heat exchange tubes, and the two second chambers are respectively connected to a refrigerant inlet pipe and a refrigerant outlet pipe.

3. The heat exchanger assembly according to claim 2, wherein the fifth partition plate in the first header pipe is located at the midpoint in the axial direction of the first header pipe, the second partition plate in the second communicating header pipe is located at the midpoint in the axial direction of the second communicating header pipe, and the third partition plate in the second header pipe is located at the midpoint in the axial direction of the second header pipe; or one of the two partition plates in the first communicating header pipe, the first partition plate and the fourth partition plate, is higher than the second partition plate in the second communicating header pipe, and the other of the two partition plates in the first communicating header pipe, the first partition plate and the fourth partition plate, is lower than the second partition plate in the second communicating header pipe.

4. The heat exchanger assembly according to claim 1, wherein the first communicating header pipe is provided with two partition plate, the first partition plate and a fourth partition plate, and thus has three first communicating chambers, two of which are the two first communicating chambers; the second communicating header pipe is provided with one partition plate, the second partition plate, and thus has two second communicating chambers, two adjacent first communicating chambers of the three first communicating chambers are in fluid communication with one of the two second communicating chambers, and the other of the three first communicating chambers is in fluid communication with the other of the two second communicating chambers; and the first header pipe has one first chamber, the second header pipe is provided with one partition plate, the third partition plate, and thus has two second chambers arranged in the axial direction of the second header pipe, the two second chambers of the second header pipe are respectively in fluid communication with the two second communicating chambers of the second communicating header pipe through the heat exchange tubes, and the two second chambers are respectively connected to a refrigerant inlet pipe and a refrigerant outlet pipe.

5. The heat exchanger assembly according to claim 4, wherein the two partition plates in the first communicating header pipe, the first partition plate and the fourth partition plate, are located on two sides of the midpoint in the axial direction of the first communicating header pipe, the second partition plate in the second communicating header pipe is located at the midpoint in the axial direction of the second communicating header pipe, and the third partition plate in the second header pipe is located at the midpoint in the axial direction of the second header pipe; or one of the two partition plates in the first communicating header pipe, the first partition plate and the fourth partition plate, is higher than the second partition plate in the second communicating header pipe, and the other of the two partition plates in the first communicating header pipe, the first partition plate and the fourth partition plate, is lower than the second partition plate in the second communicating header pipe.

6. The heat exchanger assembly according to claim 5, wherein the two adjacent first communicating chambers, on the wider side of the first heat exchanger, of the three first communicating chambers of the first heat exchanger are in fluid communication with one of the two second communicating chambers, and the other, on the narrower side of the first heat exchanger, of the three first communicating chambers is in fluid communication with the other of the two second communicating chambers.

7. The heat exchanger assembly according to claim 1, wherein the first communicating header pipe is provided with two partition plates, the first partition plate and a fourth partition plate, and thus has three first communicating chambers, two of which are the two first communicating chambers, the second communicating header pipe is provided with two partition plates, the second partition plate and a sixth partition plate, and thus has three second communicating chambers, two of which are the two second communicating chambers, and the three first communicating chambers are respectively in fluid communication with the three second communicating chambers; the first header pipe is provided with one partition plate, a fifth partition plate, and thus has two first chambers arranged in the axial direction of the first header pipe, and the second header pipe is provided with one partition plate, the third partition plate, and thus has two second chambers arranged in the axial direction of the second header pipe; two adjacent first communicating chambers of the three first communicating chambers of the first communicating header pipe are in fluid communication with one of the two first chambers of the first header pipe through the heat exchange tubes; two adjacent second communicating chambers of the three second communicating chambers of the second communicating header pipe are in fluid communication one of the two second chambers of the second header pipe through the heat exchange tubes; the other first communicating chamber of the three first communicating chambers of the first communicating header pipe is in fluid communication with the other of the two first chambers of the first header pipe through the heat exchange tubes and is in fluid communication with one second communicating chamber, at the end of the second communicating header pipe, of the two adjacent second communicating chambers of the three second communicating chambers of the second communicating header pipe; the other second communicating chamber of the three second communicating chambers of the second communicating header pipe is in fluid communication with the other of the two second chambers of the second header pipe through the heat exchange tubes and is in fluid communication with one first communicating chamber, at the end of the first communicating header pipe, of the two adjacent first communicating chambers of the three first communicating chambers of the first communicating header pipe; and the other of the two first chambers of the first header pipe and the other of the two second chambers of the second header pipe are respectively connected to a refrigerant inlet pipe and a refrigerant outlet pipe.

8. The heat exchanger assembly according to claim 7, wherein the two partition plates in the first communicating header pipe, the first partition plate and the fourth partition plate, are located on two sides of the midpoint in the axial direction of the first communicating header pipe, and the two partition plates in the second communicating header pipe, the second partition plate and the sixth partition plate, are located on two sides of the midpoint in the axial direction of the second communicating header pipe.

9. The heat exchanger assembly according to claim 7, wherein the two adjacent first communicating chambers of the three first communicating chambers of the first communicating header pipe are located on the wider side of the first heat exchanger.

10. The heat exchanger assembly according to claim 1, wherein the trapezoidal heat exchanger is vertically arranged.

11. The heat exchanger assembly according to claim 10, wherein the rectangular heat exchanger is obliquely arranged.

12. The heat exchanger assembly according to claim 11, wherein the first communicating header pipe and the second communicating header pipe are fit in parallel.

13. The heat exchanger assembly according to claim 1, further comprising an inlet pipe and an outlet pipe, wherein the inlet pipe and the outlet pipe are arranged on the second heat exchanger.

* * * * *